United States Patent [19]

Rosner

[11] Patent Number: 4,474,110

[45] Date of Patent: Oct. 2, 1984

[54] PROCESS EMPLOYING PIGMENTED WATER BASED FOAMED COMPOSITIONS

[75] Inventor: Charles A. Rosner, Old Saybrook, Conn.

[73] Assignee: Foamink Company, Fall River, Mass.

[21] Appl. No.: 419,233

[22] Filed: Sep. 17, 1982

Related U.S. Application Data

[63] Continuation-in-part of Ser. No. 360,615, Mar. 22, 1980, abandoned.

[51] Int. Cl.[3] ..... B41M 1/10; B41F 9/01; B41F 5/22

[52] U.S. Cl. ..... 101/170; 8/477; 101/123; 101/154; 101/157; 101/217

[58] Field of Search ..... 101/123, 170, 129, 154, 101/157, 217; 8/477

[56] References Cited

U.S. PATENT DOCUMENTS

| | | | |
|---|---|---|---|
| 1,082,586 | 12/1913 | Georges | 101/167 |
| 1,773,887 | 8/1930 | Stirling | 101/170 |
| 2,375,660 | 5/1945 | Jones | 101/426 |
| 2,531,036 | 11/1950 | Goettsch | 101/170 |
| 2,971,458 | 2/1961 | Kumins | 101/170 |
| 3,047,418 | 7/1962 | Compton | 427/282 |
| 3,212,916 | 10/1965 | Metcalfe | 427/282 |
| 3,400,658 | 9/1968 | Gagliardi | 101/170 |
| 4,158,076 | 6/1979 | Wallsten | 118/410 |
| 4,275,656 | 6/1981 | Choma | 101/1 |

*Primary Examiner*—Clyde I. Coughenour

*Attorney, Agent, or Firm*—Thompson, Birch, Gauthier & Samuels

[57] ABSTRACT

A printing process employing a water-based foamable ink composition comprising the following steps:

(a) foaming the ink composition, (b) applying a coating of the foamed ink composition to the surface of a gravure cylinder which has an array of open cells spaced on the surface thereof, (c) doctoring the surface of the cylinder to convert said coating into discrete thin membranes spanning said cells, and (d) transferring the membranes to a web surface, either directly, or indirectly via one or more intermediate transfer rolls.

19 Claims, 7 Drawing Figures

PROCESS EMPLOYING PIGMENTED WATER BASED FOAMED COMPOSITIONS

REFERENCE TO RELATED APPLICATION

This application is a continuation-in-part of U.S. patent application Ser. No. 360,615 filed on Mar. 22, 1982, now abandoned.

BACKGROUND OF THE INVENTION

1. Field of the Invention

This invention relates generally to the printing of moving webs, and is concerned in particular with improved paper printing and coating processes employing, in the most favorable embodiments, pigmented water based foamable ink or coating compositions.

2. Description of the Prior Art

The invention is especially useful in, but not limited to, rotogravure printing. Since its inception in the late 1800's, rotogravure printing has been carried out primarily with solvent based inks. The solvents are toxic and highly flammable, and consequently printing plant personnel are exposed continuously to potentially serious health, fire and explosion hazards. As a result, in spite of the implementation of elaborate and expensive protective measures such as for example solvent recovery and air pollution abatement systems, electrically grounded presses, shielded electric motors, etc., insurance costs have remained extremely high. Moreover, because solvents are extracted from petroleum, their costs have increased dramatically during the last decade, as has the cost of the energy consumed by the dryers required to dry the solvent inks after printing.

Some attempts have been made at avoiding these problems by employing water based inks. However, water based inks have a tendency to oversaturate the paper web. Moreover, water has a latent heat of vaporization five times that of hydrocarbon solvents, thus requiring five times as much energy to evaporate. For these reasons, the use of water based inks has not been widespread. Another attempted solution is disclosed in U.S. Pat. No. 2,971,458 (Kumins, et al), which suggests replacing solvent based inks with foamed water based inks applied directly to the web surface. To accomplish this direct foam application, Kumins stresses the importance of maintaining the size of the foam bubbles as nearly uniform as possible with the bubbles being considerably smaller than the finest engraved cells in the printing cylinder. While not specifically stated in Kumins, it would appear that these teachings are based on the theory that all of the engraved cells must be filled with or at least contain some foam bubbles in order to insure that the foam bubbles are applied to the web surface in the desired printing pattern.

It must be appreciated, however, that in rotogravure paper printing and coating, where for example the gravure cylinder has been electronically engraved by use of a Helio-Klischograph, cell depths range from a minimum of 2–3 microns to a maximum of about 40 microns. Elaborate and expensive equipment would be required to generate foam with microscopic bubble sizes considerably smaller than the smallest of such cells, and even with such equipment, it appears extremely doubtful that the Kumins teachings could be followed consistently on a commercial scale. Thus, foamed water based inks have never been employed successfully in commercial rotary gravure paper printing operations. This in spite of the substantial safety and cost advantages that could have been realized by eliminating the industry's continued reliance on solvent based inks.

SUMMARY OF THE INVENTION

The present invention lies, in part, in the surprising discovery that quite contrary to Kumins' teachings, the relative size and uniformity of the foam bubbles is not a dominant factor in the successful application of pigmented water based foamed ink in a rotary gravure printing process. Rather than attempting to fill cells with small foam bubbles, the present invention relies on an initial distribution of a layer of relatively large foam bubbles over the surface of an engraved cylinder, followed by a conversion of the bubbles through doctoring into discrete membranes spanning each of the cells, with the surface areas or "lands" of the cylinder between the cells as well as the cell interiors underlying the membranes being substantially free of ink. The membranes then may be transferred directly onto the surface of a web by simply pressing the web against the doctored gravure cylinder by means of an impression roller. Alternatively, in other processes such as flexographic printing, coating, etc., the membranes may be transferred onto the surfaces of one or more intermediate rolls before finally being applied to the web surface.

Thus it will be seen that in contrast to prior art procedures as exemplified by the Kumins patent, where foam bubbles are applied directly to the web, in the present invention the web is not exposed to foam bubbles. Rather, the foam bubbles are converted into discrete membranes which are transferred either directly from the gravure cylinder onto the web surface, or indirectly onto the web surface via intermediate transfer rolls.

The aforesaid conversion of bubbles into discrete membranes of ink, or other coating compositions, is accomplished reliably and consistently with foam bubbles which may vary in size, but which are, on the average, substantially larger than the average size cell (measured as cell depth) of a typical gravure cylinder. Thus it is unnecessary to resort to the use of elaborate and expensive foam generating equipment. Test results to date have indicated that printing in accordance with the present invention yields results at least equivalent to and in most cases superior to those achieved with conventional solvent ink printing processes, with a dramatically reduced consumption of ink on the order of approximately 50 percent. Moreover, because of the relatively small amount of ink being transferred from the gravure cylinder onto the paper web, drying takes place nearly instantaneously in ambient air, thus substantially minimizing the need to employ dryers.

The dimensional characteristics of the aforesaid membranes are largely independent of the volumetric characteristics of the cells, except that for a given surface tension, membrane thickness will vary in proportion to the open cell area. In any event, however, the membranes will deliver a smaller amount of pigment and liquid vehicle to the substrate being printed as compared with prior art solvent or water based foam systems, which rely on a loading of the cell in order to achieve effective printing.

When dealing with porous paper products of the type commonly employed in high-volume printing, this reduction in the amount of liquid vehicle is advantageous in that it results in a lesser penetration into the paper. The pigment deposition is thus more localized at the paper surface, as compared to prior art systems where the increased amounts of liquid vehicle carry the pigment deeper into the paper. Thus, when printed in accordance with the present invention, paper will exhibit a distinct reduction in "show through" i.e., the visibility of a printed image from the non-printed side of the paper. Moreover, although less pigment is being transferred onto the paper, because its deposition is more localized at the surface, the resulting image will be darker or exhibit a more vivid color as compared to the prior art processes where pigment is in effect "lost" by being carried more deeply into the paper. To the printer, the present invention's more efficient deposition of ink translates into extraordinary savings in ink costs. Moreover, because the present invention is characterized by a lesser penetration of the liquid vehicle, the printer can employ less expensive papers without resulting show through, thus further reducing the costs of printing.

The present invention also makes it possible to apply opacity-contributing or hold-out coatings. These will upgrade the printing and/or aesthetic qualities of the paper. Most importantly, it has been discovered that the extremely quick-drying characteristic of the coatings makes it possible to achieve such coatings on-line, e.g. with a coating process preceding the printing process. The surface-segregation of the coating materials might also facilitate the manufacture of thin two-sided sheet products wherein the sides are to have substantially different, even incompatible, properties. Thus, one side can bear an acidic coating while the other side can carry a basic coating. Similarly, very thin sheets may be prepared having an electro resistive face coat and an electro conductive back coat without unacceptable contamination of one coating by the other.

As previously indicated, the more efficient transfer of pigment in accordance with the present invention produces higher color intensity for a given gravure cell area as compared with the prior art processes. Thus, to achieve a given intensity, it becomes possible to decrease cell areas (and cell depths), with a corresponding increase in land areas. This translates into longer wear characteristics for the gravure rolls, again with concomitant savings in operating costs.

Another advantage of the present invention is the drastic reduction of "web breaks" which have previously been associated with paper weakened by excessive liquid absorption. This is true despite the fact that, as a general rule, aqueous systems more readily wet most inexpensive, cellulosic substrates.

Still another advantage of the present invention relates to the Helio-Klischograph process of engraving gravure cylinders. One of the concerns with this process has been the difficulty of obtaining sufficient cell volume to match the cell volumes obtained by earlier etching techniques. This problem is essentially eliminated with the present invention, since cell volume does not contribute to the efficiency of the printing operation. Rather, it is open cell area that is important, and this can be achieved easily by the Helio-Klischograph process by employing a diamond stylus with a more obtuse cutting angle.

The preferred formulations from which the foam is generated include pseudo-plastic or thixotropic additives. It is preferred that such formulations be foamed to an expanded volume of from about 3 to 20 times the volume of the liquid composition. High-stability foams of the prior art are not the most desirable. Rather, foams which have first drop drainage times of less than three hours are preferred. Those having first drop drainage times of well below one hour are entirely acceptable. As herein employed, the term "first drop drainage time" means the time, measured in accordance with the procedure specified in NFPA, STD 11, 1978 p. 11-98, that it takes for the solution contained in the foam to begin draining. Moreover, the best compositions are those in which the drainage liquid is not formed by material drained out of from bubble films; instead, it is preferred that the liquid be largely derived from breaking bubbles.

Thus, it has been found to be particularly desirable to utilize foam compositions which do not dry out before the foam bubbles break and drain. Such foams can be obtained if one avoids excessively foam-stabilized formulae. A particular advantage of such foams is that they can be readily reworked, without any substantial reformulating, simply by refoaming. Thus, the printer may utilize his material efficiently and minimize waste-disposal problems.

These and other objects and advantages of the present invention will become more apparent as the description proceeds with the aid of the accompanying drawings.

BRIEF DESCRIPTION OF THE DRAWINGS

FIG. 7 is a schematic diagram of a flexographic coating procedure in accordance with the present invention.

DETAILED DESCRIPTION OF INVENTION

Figure 1:
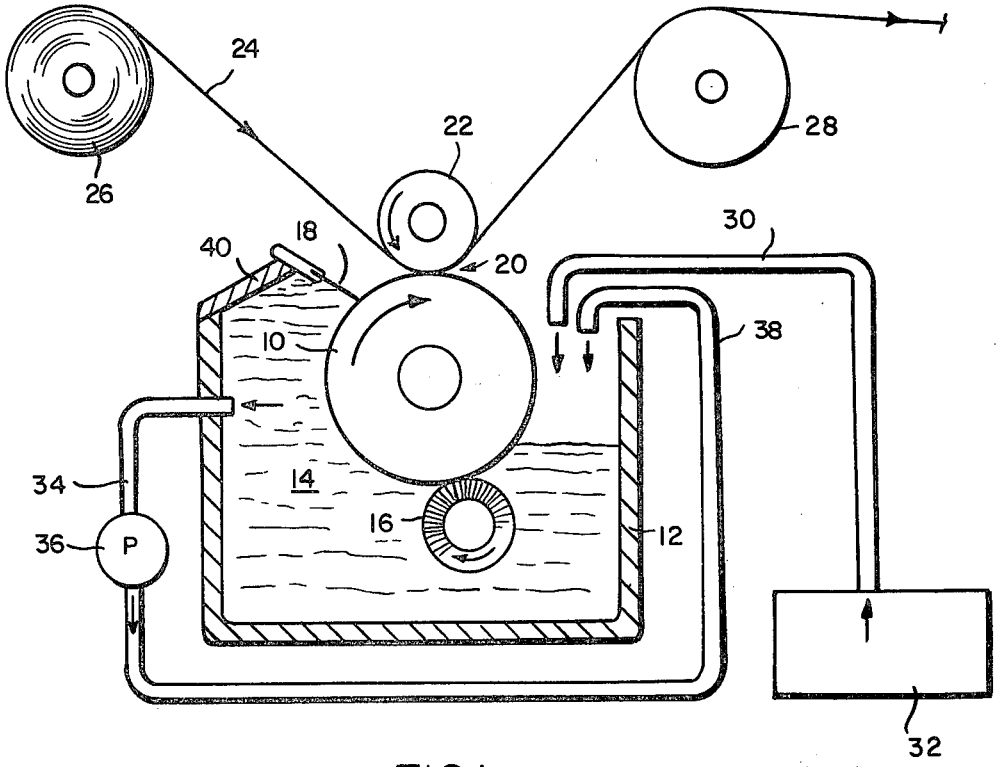
FIG. 1 is a diagrammatic view of a rotogravure printing apparatus employed in the practice of the present invention.
Figure 2:
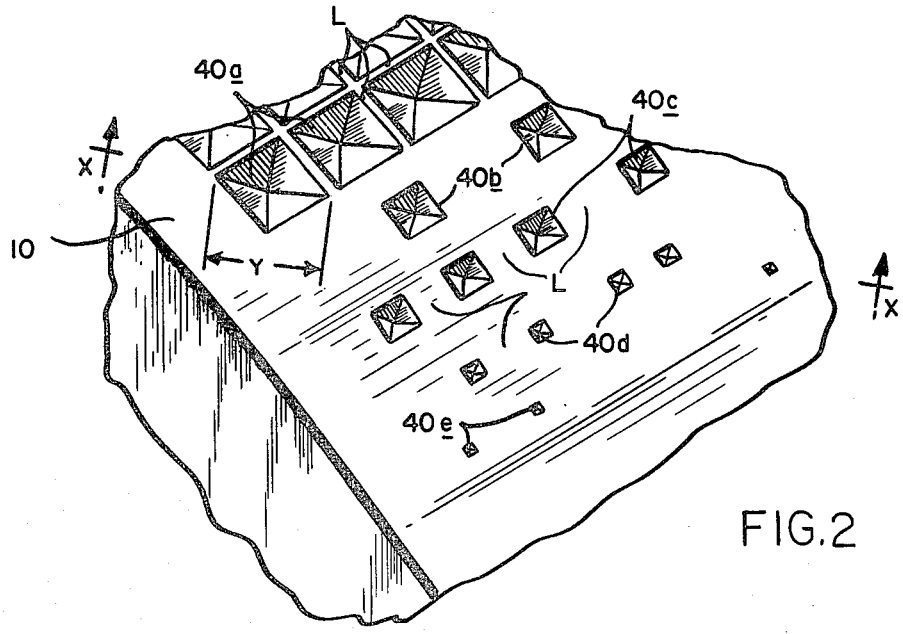
FIG. 2 is a perspective view of a portion of a gravure cylinder which has been electronically engraved with a Helio-Klischograph, and showing a range of cell sizes which have been magnified substantially for purposes of illustration.

Referring initially to FIG. 1, a rotogravure printing apparatus is shown comprising a gravure cylinder 10 rotatably mounted within the confines of an open-top fountain 12. The engraved surface of the gravure cylinder is partially submerged in a body 14 of pigmented water based foamed ink. The gravure cylinder is rotated in the clockwise direction, and its submerged surface is brushed continuously by a rotating cylindrical brush 16 submerged in the foam body 14 and also driven in the clockwise direction. A doctor blade 18 wipes the surface of gravure cylinder 10 prior to its arriving at a printing nip 20 defined between the gravure cylinder 10 and an impression roll 22. A paper web 24 is fed from a supply roll 26 through the printing nip 20 and then over a roll 28 on the way to a conventional cutting and folding apparatus (not shown).

The fountain 12 is connected via a supply line 30 to a foam generating unit 32 which operates on demand to foam a water based liquid ink or coating composition being supplied thereto. In order to compensate for the pressure build-up in the foam body 14 beneath the doctor blade 18 resulting from the continuous high speed rotation of the gravure cylinder 10 and cylinder brush 16, foam may be continuously recirculated via suction line 34, pump 36 and delivery line 38 back to the opposite side of the gravure cylinder where freshly generated foam is also being delivered via line 30.

Portions of the above-described apparatus are conventional and well known to those skilled in the art, whereas other portions are considered novel and are the subject of a separate patent application assigned to the same assignee as that of the present invention.

In the example herein chosen for purposes of disclosure, the surface of the gravure cylinder 10 has been engraved by a Helio-Klischograph, which as is well known to those skilled in the art, utilizes an electronically controlled diamond stylus (not shown) to cut out inverted pyramidal shaped cells of the type shown in FIGS. 2–6. The cells are spaced one from the other by lands "L" whose dimensions vary depending on the depths and center-to-center spacing of the cells. Open cell area (as viewed in plan) is a function of cell depth, i.e., the greater the depth to which the stylus is allowed to penetrate, the greater the open cell area.

Conventional engraving with a Helio-Klischograph will yield cells ranging in depth (shown at "X" in FIG. 3) from a minimum of 2–3 microns to a maximum of about 40 microns. Diagonal dimensions for the open areas of such cells (shown at "Y" in FIG. 2) will range from a minimum of 40 microns to a maximum of about 200 microns, and the lands "L" will have a minimum size of about 10 microns.

Some examples of foamable ink formulations utilized in the process of the invention are listed below. The following designations are used in these formulations:

PP: a thixotropic or pseudoplastic-contributing additive; 50% by weight Kelco K8A13 (heteropolysaccharride-7) slurried in 150% by weight Butyl Carbitol® obtained from Union Carbide Corp.

Pigment 1123: 100% Sunsperse Yellow YFD-1123 (35% solids) by Sun Chemical Corp.

Foamer: high-expansion foam concentrate called "High Expansion Foam" and obtained from National Foam Systems, Inc.

FJC-55: 25%.$H_2O$/50% $NH_4OH$/25% Joncryl 678

Surfactant L-7129: A silicone surfactant available from Union Carbide Corp.

F-122: 35% carbon block pigment/5.6 Nitrile resin (Atromax-Vinitone)/59.4% water Resin 678: an alkali-soluble styrene acrylic acid copolymer sold under the designation Joncryl 678 by S. C. Johnson & Sons Co.

EXAMPLE A

| Weight % | |
|---|---|
| 54.8 | $H_20$ |
| 0.2 | PP |
| 11.0 | resin FJC-55 |
| 28.6 | pigment 1123 |
| 0.4 | Foamer |
| 5.0 | ethylene glycol |
| ph | 10.0 |
| surface tension: | 36.9 |
| Expansion ratio: | 12.4 |
| first drop drainage: | 35 minutes |

Ethylene glycol was added as a foam conditioner and the amount of pseudoplastic material was increased to 0.20%. Although the foam lacked consistency, the formula was applied successfully to a paper web. No change in color intensity was noted after a run of 1½ hours. No indication of growth was noticed.

EXAMPLE B

1% silicone surfactant (L-7129) was added to the formula of Example A. The addition of the surfactant resulted in a uniform foam. The formula was successfully applied to a paper web. No change in color intensity or growth in one hour.

| | |
|---|---|
| ph: | 9.9 |
| surface tension: | 33.0 dynes $cm^{-1}$ |
| Expansion ratio: | 6.4 |
| first drop drainage: | 32 minutes |

EXAMPLE C

The formula of example A was modified by increasing the weight percent of the resin from 11.0% to 20.0% and correspondingly decreasing the water content from 54.8% to 45.8%. This formula was successfully applied to a paper web. No change in color intensity was noted.

EXAMPLE D

The formula of Example C was modified by adding 1% silicone surfactant (L-7129). This formula was successfully applied to paper web. The foam had the following characteristics:

| | |
|---|---|
| ph: | 10.0 |
| surface tension: | 35.9 dynes $cm^{-1}$ |
| first drop drainage: | 33 minutes |

No change in color intensity and very little foam growth.

EXAMPLE E

| % by weight | |
|---|---|
| 46.60% | $H_20$ |
| 0.20% | PP |
| 5.00% | ethylene glycol |
| 20.00% | resin FJC-55 |
| 28.60% | pigment 1123 |
| 0.60% | foamer |
| 0.05% | suractant L-7129 |

EXAMPLE F

| % by Weight | |
|---|---|
| 20.00 | pigment F-122 |
| 0.20 | PP |
| 2.70 | $NH_4OH$ |
| 10.00 | resin 678 |
| 5.00 | ethylene glycol |
| 61.00 | $H_2O$ |
| 0.60 | foamer |
| 0.05 | surfactant L-7129 |
| 0.01 | perfluorocarboxylic acid |

The perfluorocarboxylic acid has the formula:

$$C_{F2n+1}COOH$$

where N=5−12.

The perfluorocarboxylic acid was added to enhance the surface tension of the foam. The formula successfully coated a transfer roll in a flexographic process.

The above liquid formulations were mixed by the foam generating equipment 32 with a pressurized gas such as air at the above specified expansion ratios, without attendant mechanical agitation. The resulting foams had non-uniform bubble sizes (determined by bubble diameter) ranging from about 5 to 100,000 microns. Thus, the median bubble size was larger than the maximum cell depth of the gravure cylinder, and observations of experimental runs indicated that median bubble size was substantially larger than the median maximum lateral dimension of the open cell areas.

Figure 3:
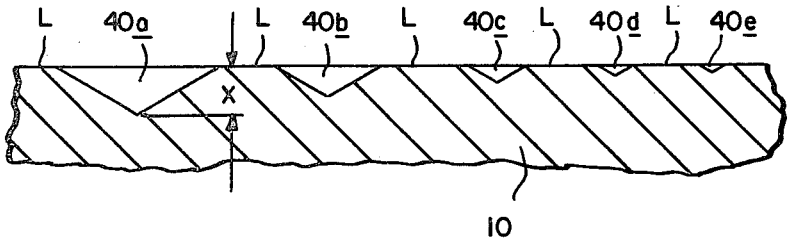
FIGS. 3-6 are substantially magnified sectional views taken along the line X—X of FIG. 2 showing in a diagrammatic manner the progressive steps entailed in carrying out a rotogravure printing process in accordance with the present invention.

Turning now to FIGS. 3–6, the condition of the gravure cylinder surface immediately after its passage through the printing nip 20 and prior to its re-entry into the foam body 14 is shown in FIG. 3. The entire cylinder surface, including the differently sized open cells 40*a*–40*e* and the lands L therebetween is substantially free of ink.

Figure 4:
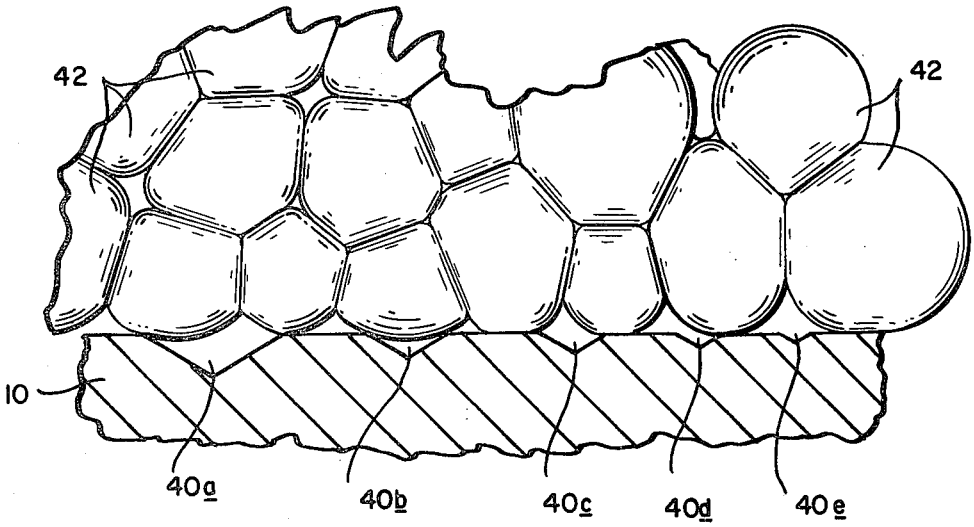

FIG. 4 shows the condition of the gravure cylinder surface after it has entered the foam body and has been exposed to the brushing action of roll 16, but prior to its being wiped by the doctor blade 18. At this stage, the cylinder surface is coated with foamed ink in the form of randomly distributed bubbles 42 which, as mentioned above, vary in size, with the minimum bubble diameter being larger than the maximum cell depth, and with the median bubble size being larger than the median maximum lateral dimension of the open cell areas.

Figure 5:
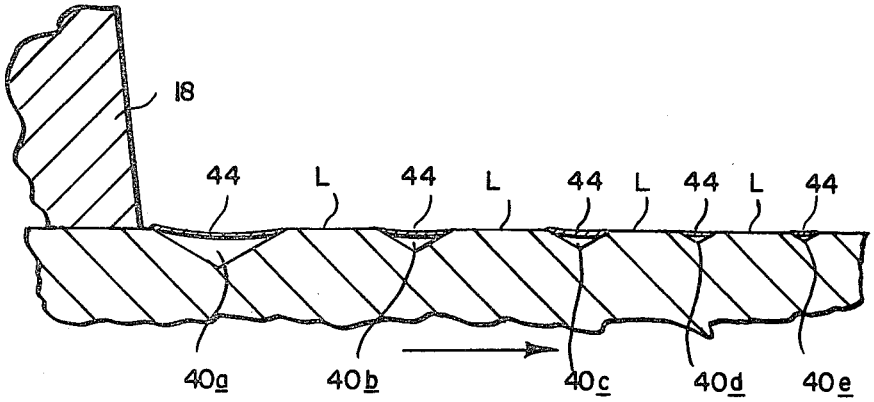

FIG. 5 shows the condition of the gravure cylinder surface immediately after it has been wiped by the doctor blade 18 but prior to its entry into the printing nip 20. It will be seen that the bubble coating shown in FIG. 4 has been converted by doctoring into discrete extremely thin membranes 44 covering or spanning the cells 40*a*–40*e*. The above-stated relationship between bubble size and cell depth is believed to contribute to this result by insuring that a major percentage of the bubbles are only partially received in the cells and thus are exposed to the wiping action of the doctor blade. The lands L between the cells, and the interior cell portions underlying the membranes are free of ink, or at least substantially so.

Figure 6:
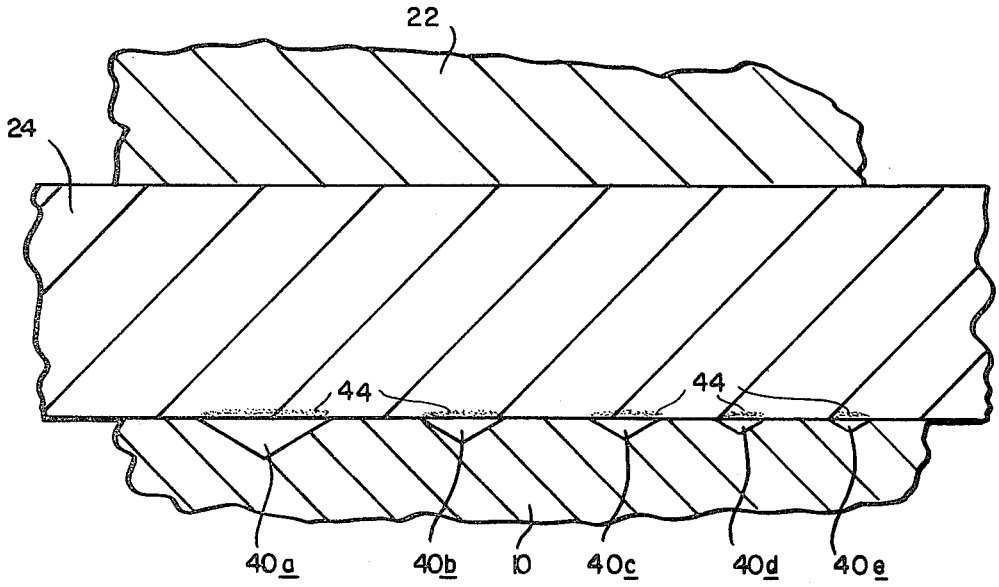

FIG. 6 shows the condition of the gravure cylinder surface as it passes through the printing nip 20 where it is brought into contact with the paper web 24. At this stage, the thin membranes 44 are picked up by the web, leaving the cylinder surface free of ink in the condition shown in FIG. 3.

Experimental runs with the process of this invention have yielded excellent results comparable in every way to those achieved with conventional solvent inks. Surprisingly, these results have been achieved with foams of relatively large bubble size, in direct contravention to the teachings of the prior art.

While the process of the present invention has been described in connection with cylinders engraved by a Helio-Klischograph, it will be understood that other types of engraved cylinders, i.e., those engraved by chemical or other mechanical means, also can be employed with equivalent results.

As shown in FIG. 7, the process of the present invention also may be employed in flexographic printing. Here, an engraved anilox cylinder 50 is partially submerged in and rotated through a body 52 of foamed ink, the latter having been generated and delivered in accordance with previously described techniques. A rotating submerged brush 54 again is employed to achieve appropriate distribution of foam over the surface of the anilox cylinder. The foamed ink coating is then doctored as at 56 to convert the same to the previously described membranes spanning the engraved cells. Rather than being applied directly to a web, however, the membranes are then transferred to and deposited on the surface of a rotating intermediate rubber transfer roll 58. From here, the membrane deposits are transferred to the raised areas of a flexographic printing plate 60. Finally, the membrane deposits are applied to the surface of a moving web 62 which is pressed against the printing plate by an impression roll 64.

It will thus be seen that in a broad sense, the present invention consists of a printing or coating process employing a water-based foamable composition. The formulation is foamed and applied to the surface of gravure or anilox cylinders, with the foam bubbles being randomly sized and significantly larger on average as compared to the average cell size of the cylinders. The cylinder surfaces are then doctored to convert the foam bubbles into thin discrete membranes which span or overlie the open cells, leaving the cell interiors underlying the membranes as well as the lands separating the cells substantially free of ink or coating deposits. The membranes are then transferred, either directly or indirectly, onto the surface of a moving web.

I claim:

1. A process for applying a water-based liquid composition containing dissolved or suspended solids to a moving web comprising the steps of:

(a) foaming said composition;

(b) applying a coating of the foamed composition to a cylinder having an array of mutually spaced open cells on the surface thereof, the said composition comprising non-uniform foam bubbles having a median size (measured as bubble diameter) larger than the median maximum lateral dimensions of said cells;

(c) converting the coating of the foamed composition to discrete liquid composition membranes spanning said cells, with the cell volumes beneath said membranes as well as the land areas between said cells being substantially free of said composition;

(d) transferring said liquid composition membranes to the surface of said web and immobilizing said solids on the surface of said web as a residue formed of said solids.

2. A process as defined in claim 1 wherein said web is a paper substrate and wherein said solids comprise printing inks selectively distributed over said substrate.

3. A process as defined in claim 1 wherein said substrate is paper, wherein said membranes are first transferred to a transfer roll on which they are applied as a continuous coating, then transfered to said paper, and wherein said solids comprise means to modify surface properties of said paper surface.

4. A process as defined in claims 1, 2 or 3, wherein the transferring of said liquid membranes takes place immediately after conversion of said foam to said liquid membranes.

5. A printing process as defined in claim 1 wherein the transferring of said liquid membranes from said cylinder surface to said web comprises the subsidiary steps of:

(a) a first transferring of said liquid membranes to a transfer roll system, said transfer roll system comprising means to convert said liquid membranes to a continuous film; and, (b) a second transfer of portions of said film to a printing plate followed by a final transfer of said film portions from said printing plate to a surface of said web.

6. A process as defined in claim 5 wherein said printing roll is a flexographic printing roll.

7. A process as defined in claim 5 wherein said moving web is a paper sheet.

8. A process as defined in claims 1, 2 or 3 wherein said foamed composition has a density of from about 6 to about 16 lbs./ft.$^3$.

9. A process as defined in claims 1, 2 or 3 wherein said foam is characterized by such instability on drainage, that the foam will break down and yield a drainage liquid that is suitable for direct recycling into said process.

10. A process as defined in claims 1, 2 or 3 wherein the first drop drainage time of said foamed composition is less than about 4.0 hours.

11. A process as defined by claims 1, 2 or 3 wherein the liquid composition from which said foam is formed is a pseudoplastic liquid.

12. A process as defined in claims 1, 2 or 3 wherein said foamed composition is formed of a pseudoplastic liquid composition and is characterized by a density of less than about 16.0 lbs./ft.$^3$ and is such that upon drainage, foam bubbles will break to yield a drainage liquid that is suitable for direct recycling into said process.

13. A process as defined in claims 1, 2 or 3 wherein the first drop-drainage time of said foam is less than about three hours, and the drainage liquid is a pseudoplastic liquid which may be refoamed to a foam of a density of less than about 16 lbs./ft.$^3$ for recycling into said process.

14. A rotary gravure printing process employing a water-based liquid ink composition, said process comprising:

(a) foaming said liquid ink composition;

(b) applying a coating of said foamed ink composition to the surface of a rotating gravure cylinder, the surface of said cylinder having an array of differently sized open cells spaced one from the other and said foamed ink composition having a median bubble size (measured as bubble diameter) which is larger than the maximum depth of said cells;

(b) doctoring the surface of said cylinder to convert said coating into discrete membranes spanning said cells, with the surface areas of said cylinder between said cells as well as the cell interiors underlying said membranes being substantially free of ink; and (c) transferring said membranes onto the surface of a web by pressing said web against said cylinder.

15. The printing process of claim 14 wherein said cells have depths ranging from about 2 to 40 microns, and wherein said foam has a median bubble size (measured as bubble diameter) larger than 40 microns.

16. The printing process of claim 15 wherein said foamed ink composition has a bubble size (measured as bubble diameter) ranging from about 5 to 100,000 microns, wherein the maximum cell depth is about 40 microns, and wherein the maximum lateral dimension of the open cell areas when viewed in plan ranges from a minimum of 40 microns to a maximum of about 200 microns.

17. The printing process of claim 14 wherein the application of said coating to the surface of said cylinder is achieved by partially submerging and rotating said surface in a body of said foamed ink composition.

18. The printing process of claim 17 wherein the surface of said cylinder is mechanically brushed while submerged in said body.

19. A rotary gravure printing process, comprising:

(a) generating a water based foamed ink composition having a non-uniform bubble size (measured as bubble diameter) ranging from about 5 to 100,000 microns;

(b) applying a coating of said foamed ink composition to the surface of a rotating gravure cylinder, the surface of said cylinder having an array of differently sized open cells spaced one from the other, said cells having depths ranging from about 2 to 40 microns, and having maximum lateral dimensions when viewed in plan ranging from about 40 to 200 microns;

(c) doctoring the surface of said cylinder to convert said coating into discrete membranes spanning said cells, with the surface areas of said cylinder between said cells as well as the cell interiors underlying said membranes being substantially free of ink wherein the median size of the bubbles is larger than the median maximum lateral dimensions of said cells; and (d) transferring said membranes onto the surface of a web by pressing said web against said cylinder.

* * * * *